United States Patent [19]

Esser

[11] Patent Number: 4,537,139

[45] Date of Patent: Aug. 27, 1985

[54] GRATE OF INCINERATOR

[75] Inventor: Anton Esser, Kaarst, Fed. Rep. of Germany

[73] Assignee: Deutsche Babcock Anlagen Aktiengesellschaft, Oberhausen, Fed. Rep. of Germany

[21] Appl. No.: 608,022

[22] Filed: May 3, 1984

[30] Foreign Application Priority Data

May 5, 1983 [DE] Fed. Rep. of Germany ..... 3316363

[51] Int. Cl.[3] ..... F23K 3/18

[52] U.S. Cl. ..... 110/276; 110/246; 110/257; 110/287; 110/328

[58] Field of Search ..... 110/246, 248, 255, 257, 110/258, 268, 275, 276, 277, 281, 287, 288, 327, 328

[56] References Cited

U.S. PATENT DOCUMENTS 1,831,816 11/1931 Magrath ..... 110/276
2,501,763 3/1950 Denker et al. ..... 110/276
3,469,544 9/1969 Kremer ..... 110/246
4,320,710 3/1982 Steiner et al. ..... 110/281

FOREIGN PATENT DOCUMENTS 1164014 2/1964 Fed. Rep. of Germany .

*Primary Examiner*—Henry C. Yuen
*Assistant Examiner*—Steven E. Warner
*Attorney, Agent, or Firm*—Michael J. Striker

[57] ABSTRACT

A drum-shaped grate of an incinerator includes a plurality of cylindrical drums, the grate covering of which is formed of a plurality of suspended middle grate bars which are combined in segments and arrested by fixed grate bars. The adjacent grate bars in the circular direction are suspended on bar carriers and the lateral faces of each two adjacent grate bars are spaced from each other by spacers. The surfaces of the spacers positioned between each two adjacent grate bars and abutting against each other are flat and smooth. Due to a possible relative displacement of the middle grate bars in their longitudinal direction owing to the placing of the spacers between the adjacent bars a clogging of the air slots formed between the grate bars would be prevented.

8 Claims, 6 Drawing Figures

GRATE OF INCINERATOR

BACKGROUND OF THE INVENTION

The present invention relates to incinerators in general, and more particularly to an incineration travelling grate of an incinerator, which grate comprises a plurality of axially parallel rollers rotated in a common direction and supporting refuse fed into the incinerator.

Roller or drum-shaped grates have been known in incinerators, particularly for burning solid refuse, such as house refuse. The refuse-supporting grate is formed of a plurality of drums positioned one after another in a descending manner and axially rotated in the same direction. Refuse is fed onto the uppermost drum and transported to the further drums due to their rotation while this refuse is burned.

Each drum is provided on its periphery with a plurality of grate bars positioned such that air slots for combustion air are formed therebetween. Combustion air is normally fed in the interior of the hollow drum and then is radially discharged through the air slots onto the fire space size. Combustion air at the same time serves as cooling air for the grate bars.

Generally, differently-formed grate bars have been utilized for covering the outer periphery of the grate drum. The predominant portion of the drum surface is formed by the grate bars suspended between respective grate bar carriers; the suspended grate bars being arrested in the segment-like manner with the fixed grate bars which are rigidly secured by screws to the bar carriers from the inner side of the drum.

In operation the grate bars are subjected to high loads and therefore to substantial wear, the magnitude of which significantly increases due to high temperatures. Furthermore, occasional mechanical damages by certain solid particles in a refuse are not avoided. Due to wear and damage therefore regular and also irregular interchanges of the grate bars have been required.

In addition, service-life of the grate bars are shortened considerably by metals melting at operating temperature, for example, alumina, zink, tin, contained in the refuse being incinerated. These metals melting during the incineration of refuse flow into the air slots between the grate bars, where they are cooled and solidified. Therefore caking takes place in the air slots, which caking gradually accumulates. If disturbances occur in the combustion air feeding system the clogged portion of the coating of the grate bar must be totally replaced.

The incineration grate of the type under discussion is disclosed in German patent publication DE-PS No. 11 64014. The grate is formed of grate drums provided with inserts through which drops of melted metal are collected in the interior of the drum. Thereby the clogging of the air slots on the side facing away from the combustion chamber is prevented.

U.S. Pat. No. 3,469,544 discloses a grate drum, the outer periphery of which is covered with grate bars of various different shapes. In addition to grate bars, the heads of which are toothed or wave-shaped, there are bars shown which have straight-line surfaces. There is no showing how the grate bars are secured to the drums and there are no spacers.

SUMMARY OF THE INVENTION

It is an object of the present invention to provide an improved incineration grate.

It is another object of the present invention to provide an incineration grate in which the service life of the grate bars will be prolonged and a repairing work is no longer required in short periods of time.

These and other objects of the invention are attained by a refuse-supporting grate of an incinerator, comprising a plurality of hollow rotary cylindrical drums each having an outer peripheral surfaces receiving refuse thereon, each drum having a central axis and including a plurality of grate bars extended parallel to each other and forming said outer peripheral surface, grate bar carriers extended parallel to said central axis, said grate bars being suspended in the direction transversal to said central axis between said carriers and on the latter so that between each two adjacent grate bars air slots are formed, each grate bar including a head portion having two sides faces which are straight-line and smooth; and spacers between said grate bars, said grate bars each further including a foot portion having two opposite lateral faces, said spacers being positioned in pairs between the one lateral face of one grate bar and the lateral face of the adjacent grate bar, facing towards said one lateral face, the spacers in each pair having abutting surfaces abutting against each other, said abutting surfaces being flat and smooth.

Because of a play between the grate bar carriers and due to the smooth and flat abutting surfaces of the spacers the suspended grate bars are able to move relative to each other in their longitudinal direction during the operation. Therefore a clogging of the air slots between the grate bars, which can be caused by a caking of metals contained in a refuse being combusted, is prevented.

Each of said suspended grate bars may have two opposite recesses and two extended portions above said recesses, said bar carriers being partially inserted in said recesses.

Each bar carrier may be inserted into the assigned recess so that a play of at least 1 mm occurs between the respective extended portion of the suspended grate bar and the respective bar carrier at operation temperature.

Each suspended grate bar may have a cooling fin-surface and a combustion track surface, the ratio between the cooling fin-outer surface area and the combustion track surface area being at least 8:1. Thereby a better cooling of the grate bars which would reduce wear of the bars would be provided.

Each drum may have marginal zones and a middle zone in the direction of said central axis, the width of the grate bars in said marginal zones being greater than the width of the grate bars in said middle zone. Thereby combustion air would be directed through the air slots towards the combustion bed and be uniformly fed thereonto.

The grate bars may extend one after another along a circumferential circle to form parallel circular rows of the grate bars, and may include fixed grate bars arranged in parallel circular rows, the circular rows of the fixed grate bars replacing some of the circular rows of said suspended grate bars, and connecting elements accessible from outside the drum for releasably connecting the fixed grate bars to the respective bar carriers.

Each fixed grate bar may include a lateral recess at one side of the bar and a lateral projection at another side of the bar, said fixed grate bars being positioned in each circular row so that the lateral projection of one fixed bar is inserted in the lateral recess of the adajcent fixed bar. Thereby an interchange of the grate bars is possible and can be carried out very fast from the side of the combustion chamber of the incinerator.

Each fixed grate bar may have an outer combustion surface, said combustion surface having a plurality of openings. Thus combustion air fed in the region of the fixed grate bars is not interrupted.

Each of said lateral projections is inserted into the assigned lateral recess over the entire width of the respective fixed grate bar. Thereby flowing of melted metal into the interior of the grate drum is prevented.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DETAILED DESCRIPTION OF THE PREFERRED EMBODIMENTS

Figure 1:
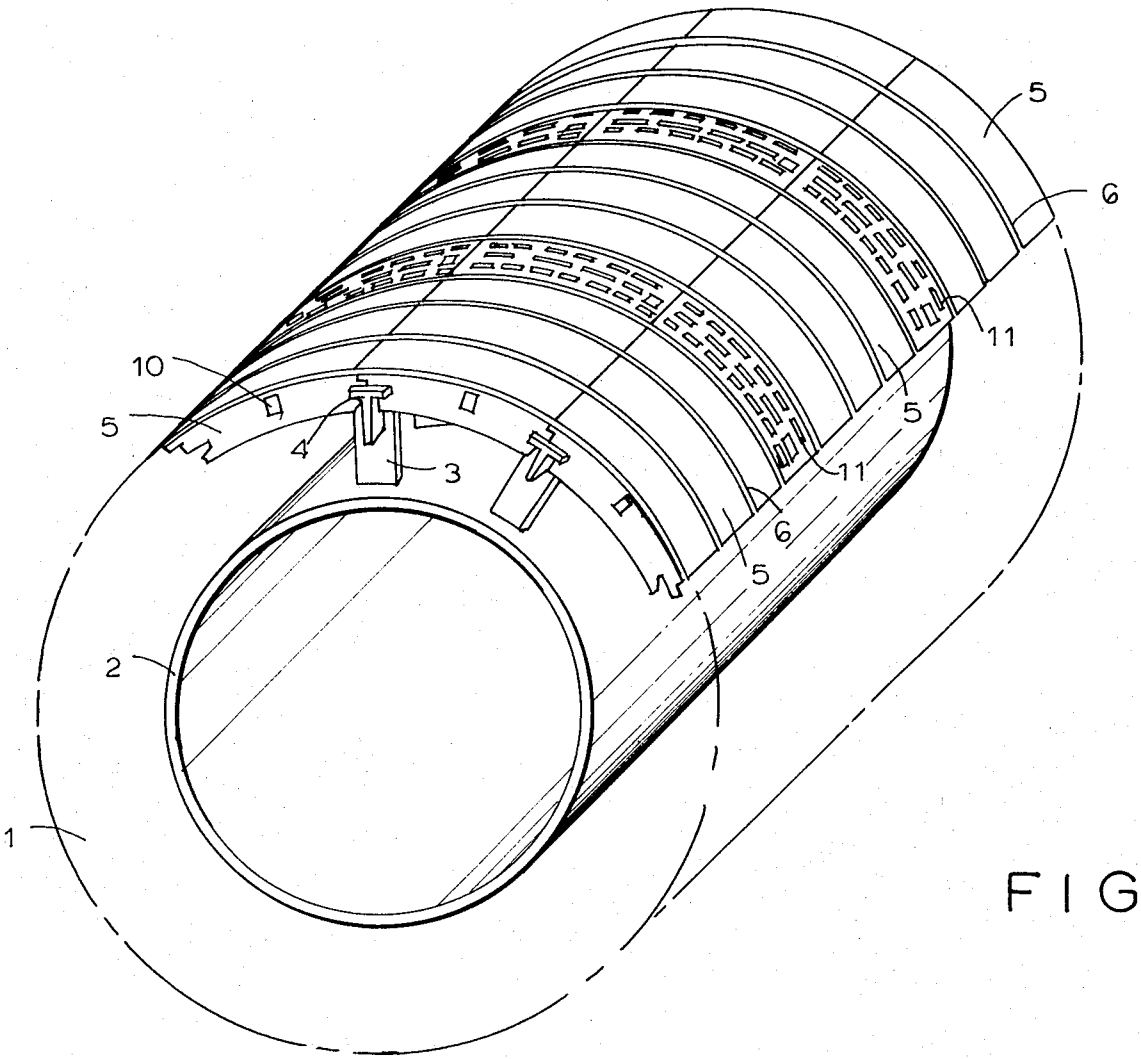
FIG. 1 is a schematic perspective view of the portion of the grate drum with the suspended grate bars of the same width.

The drum-shaped grate of an incinerator includes a plurality of drums or rollers 1 arranged axially parallel to each other and one after another and which are rotatable in the same direction and positioned in a downwardly inclined manner so that refuse fed onto the uppermost drum will move downwardly towards the lowermost drum in the known fashion described, for example in U.S. Pat. No. 3,469,544 the entire disclosure of which is incorporated herein by reference.

Each grate drum 1 includes a driven or rotatable hollow shaft 2 formed as a horizontally extended cylinder, to the outer surface of which circumferentially distributed holding rings 3 for elongated grate bar carriers 4 are connected. Bar carriers 4 extend parallel to the central axis of drum 1. Transversally between the grate bar carriers 4 which are spaced from each other at the same distance and extend over a straight line parallel to the central axis of the hollow shaft 2 grate members or bars 5 are suspended.

Figure 4:
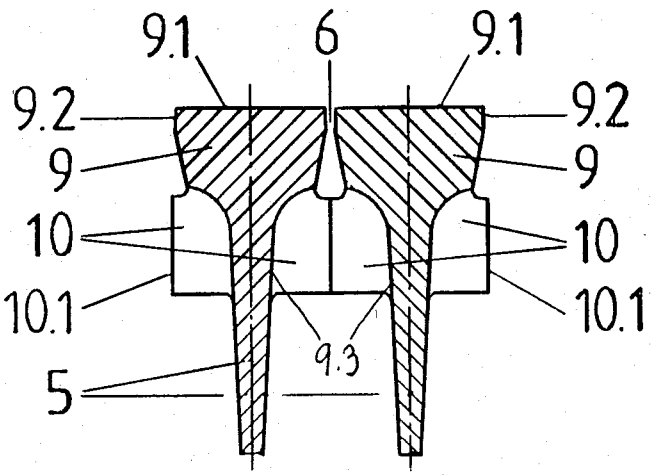
FIG. 4 is a sectional view taken along line IV—IV of FIG. 3.

Grate bars 5 therefore form the outer circumferential surface of the drum. The outer surfaces 9.1, of the grate bars 5, seen in FIG. 4, extend parallel to each other over circular orbits (combustion grate paths), between which air slots 6 are positioned.

Each grate bar 5 has a substantially T-shaped cross-section, while its outer surface is substantially circular and follows the outer limiting line of the periphery of the drum 1.

Figure 3:
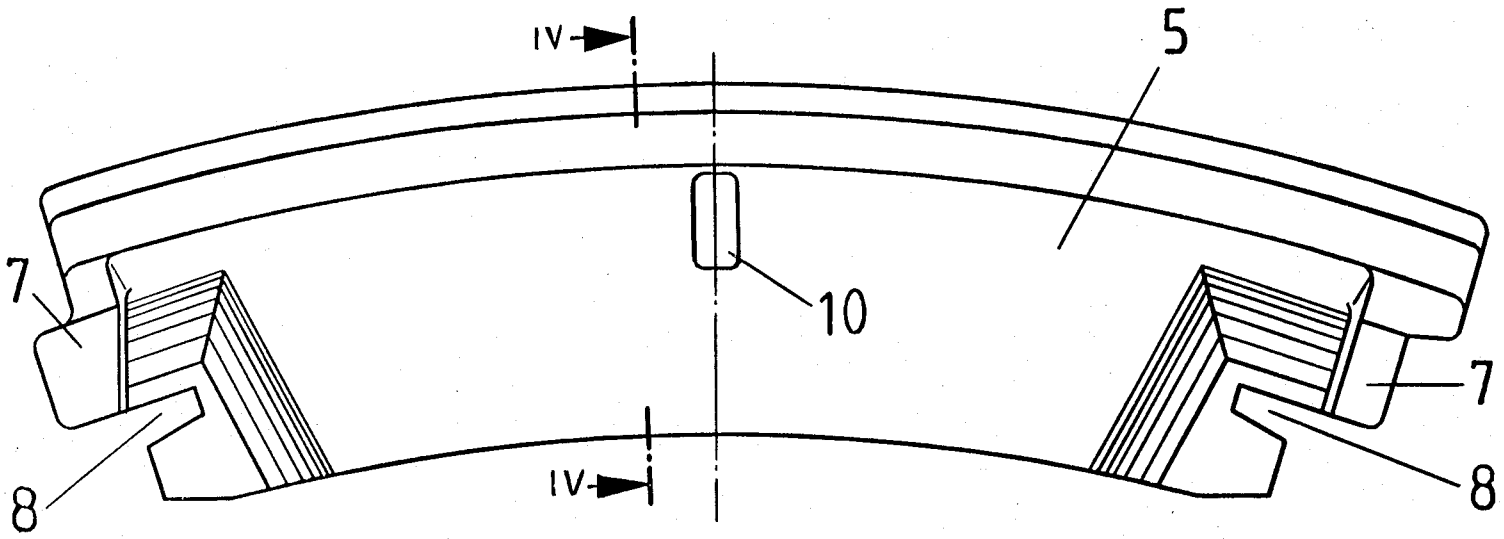
FIG. 3 is a front view of the individual suspended grate bar.

As clearly seen in FIG. 3, at two ends of each grate bar 5 in the transversal direction are formed recesses 8, in which the respective projections of grate bar carriers 4 for holding the bars to the surface of shaft 2, are engaged. Each bar carrier 4 is of T-shaped configuration and has two outwardly extending projections inserted into recesses 8 of adjacent grate bars 5, respectively. The outer surface 9.1 of the grate bar head 9 is smooth and even; this surface forms a portion of the grate combustion surface, and side surfaces 9.2 of the grate bar head 9 of each middle grate bar 5 are smooth and straightline.

Side surfaces 9.3 of the foot portions of each two axially adjacent grate bars 5, facing towards each other, are held in a spaced relationship with respect to each other by means of spacers 10 which are positioned at both sides of each grate bar 5 and extend laterally of each side surface 9.3. Due to the provision of spacers 10 and by arranging the spacers in pairs between the neighboring grate bar 5 air slots 6 are formed therebetween. The abutment surfaces 10.1 of the spacers 10 are smooth and flat. The cooling fin surface of the grate bar 5, which is the part of its outer surface, onto which combustion air passes in its path into the combustion bed and therefore is constituted substantially by the side surfaces 9.3 which have fins for enlarging the cooling surface and the side surfaces 9.2 of the grate bar head 9, also the uncovered outer surface within the grate drum 1, is at least 8 times greater than the combustion track surface (equal to the outer surface 9.1).

When the grate bars 5 are suspended on bar carriers 4, a play of at least 1 mm occurs between each laterally extended portion 7 of the grate bar 5 and the bar carrier 4 inserted in the respective recess 8 at operation temperature.

The grate combustion tracks are formed at uniform axial distances from each other by fixed bars 11 which, at certain positions, are rigidly secured, for example by screws 14, to the grate bar carriers 4 in place of grate bars 5. The fixed grate bars 11 lock the median bars 5 and, because carriers 4 are discontinued at some locations of fixed bars 11 the latter subdivide drum 1 into segments.

Figure 5:
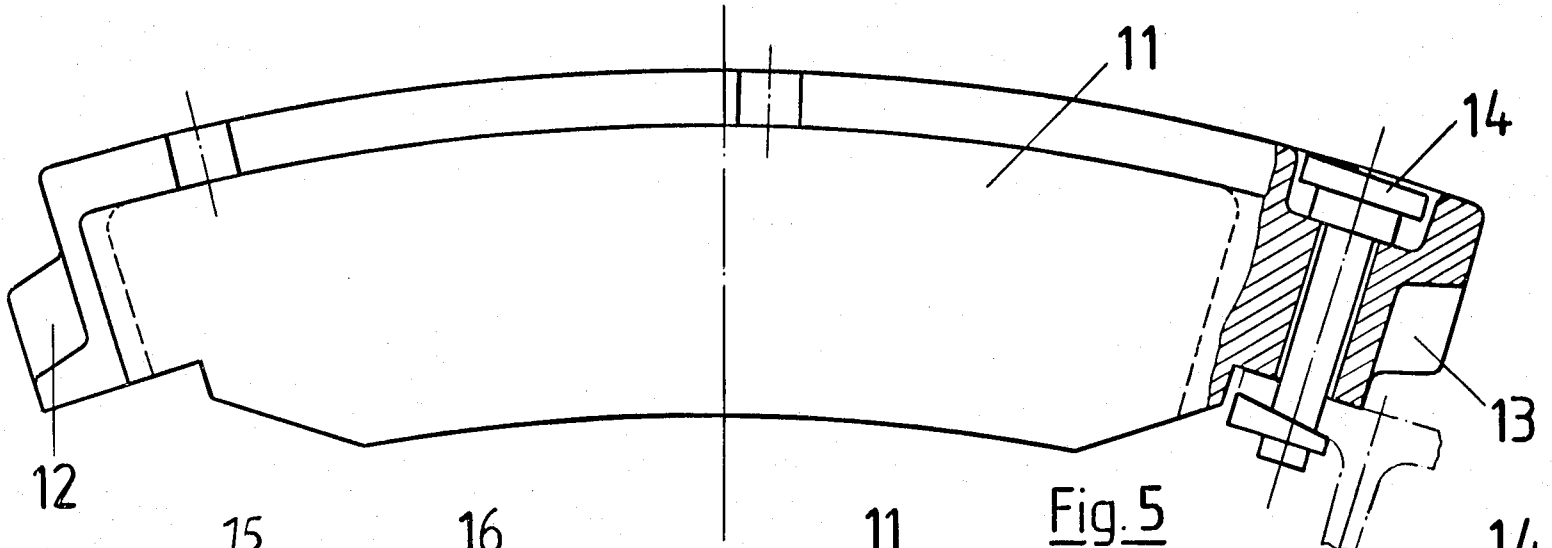
FIG. 5 is a front view, partially in section of the fixed grate bar.
Figure 6:
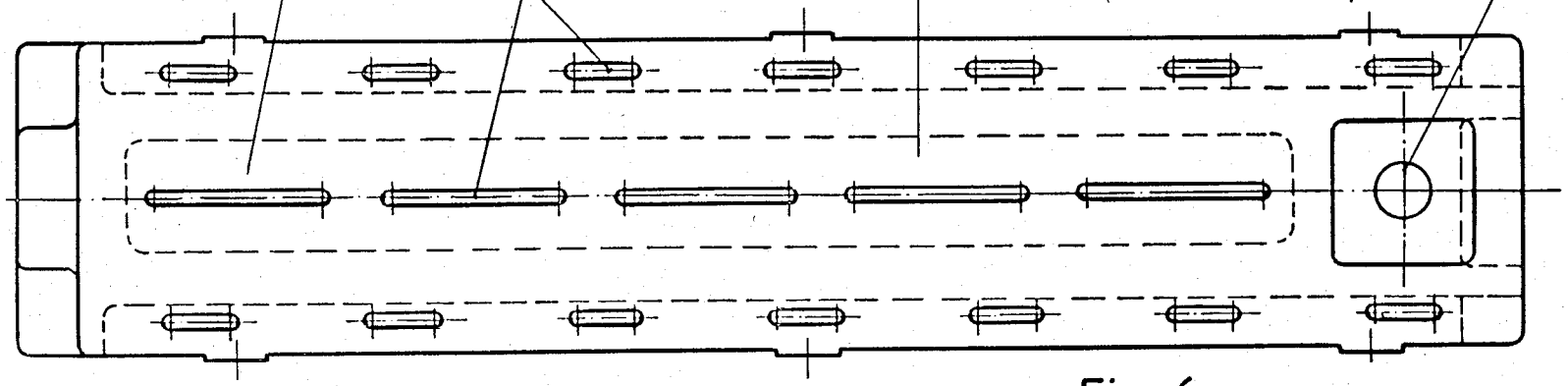
FIG. 6 is a top plan view of the fixed grate bar of FIG. 5.

The fixed bars 11 are, in the direction corresponding to the periphery of the drum 1, curved, as seen in FIG. 5. A lateral projection 12 is formed at the side of the fixed bar 11, which projection, upon assembling of the drum, passes into a respective recess 13 of the adjacent bar 11, formed at the other side of the fixed bar. The fitting of the projection of one bar 11 onto the respective recess of the laterally adjacent bar 11 extends over the entire width of each fixed bar so that no vertical gaps at the transition zones between each two adjacent fixed bars 11 occur. Thereby this construction secures the drum against the penetration of the flowable metal thereinto. The combustion surface 15 of the fixed bars 11 has additional slots or openings 16 for combustion air.

Figure 2:
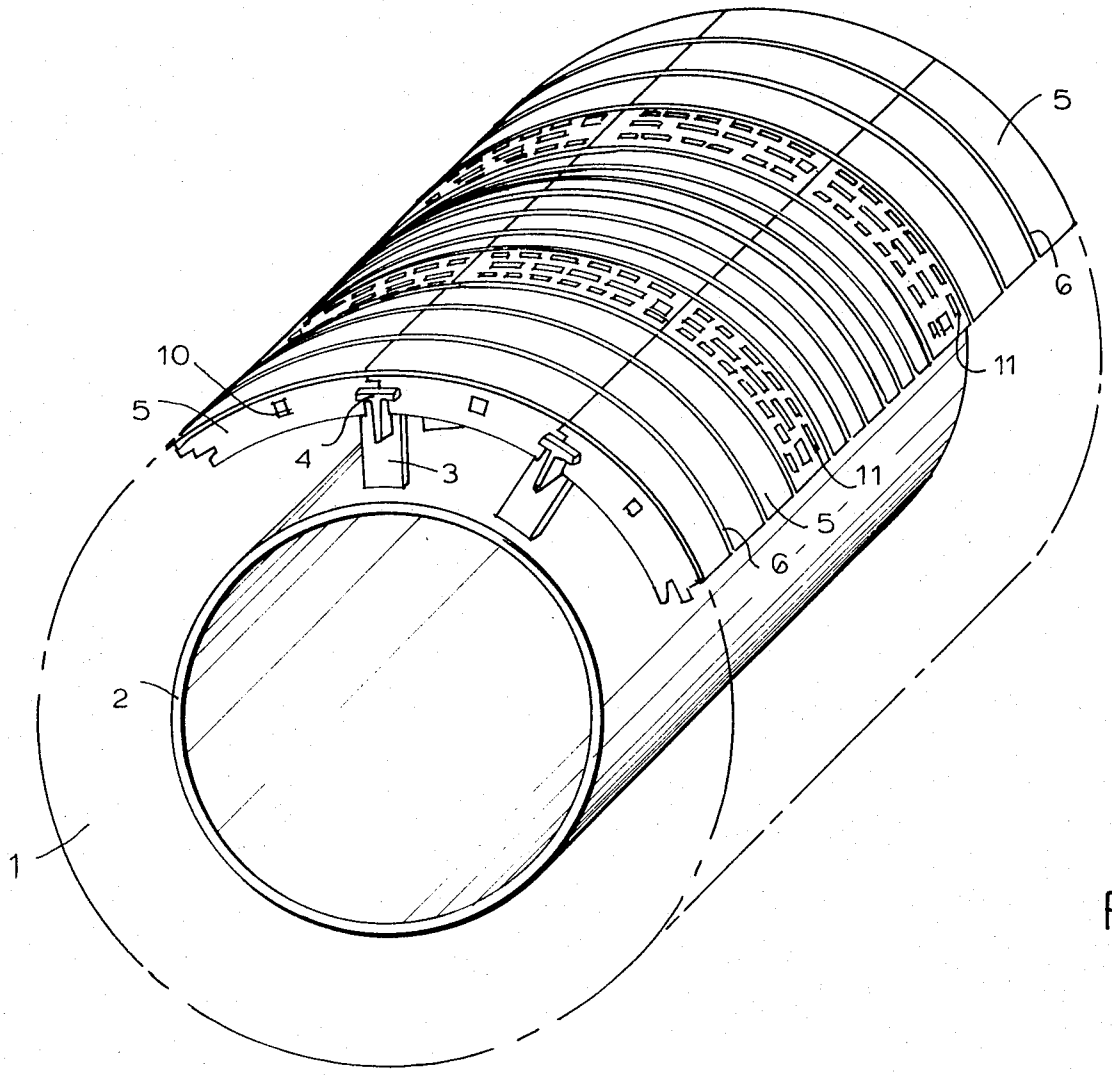
FIG. 2 is a schematic perspective view of the portion of the grate drum with the suspended grate bars of various widths.

It is possible to use the grate drum grate members or bars 5 of various widths, for example to use narrower grate bars 5 in the median area of the grate drum and wider grate bars 5 in the marginal areas of the drum, as in the embodiment of FIG. 2, so that the feeding of combustion air into the combustion bed transversally of the direction of transporting of the refuse is controlled. It is also possible to provide additional drums of the grate with the grate coverings of various different shapes in order to additionally optimize the combustion air feeding in respect to the direction of the refuse transport.

Due to the design of the spacers a relative displacement of th grate bars 5 relative to each other in the direction of the drum is possible, which would prevent a clogging of the air slots 6 due to caking of a meltable material metal contained in a refuse being incinerated.

In operation individual drums 1 rotate in the same direction. Refuse is fed onto the uppermost grate drum 1 and is combusted during its transport in the downward direction to the lowermost grate drum. Combustion air flows axially in grate drums 1 and exits radially through air slots 6 and openings 16 at the upper surface of grate members or bars 5 and 11. Combustion air, in its way passes along the cooling fins of the grate bars 5 whereby grate bar 5 are cooled down. Due to the relatively large surface of the cooling fins a satisfactory heat exchange is warranted so that even with the large portion of blocking refuse the grate bars 5 are sufficiently cooled. Because of such a decrease of temperatures in the regions of the grate covering during the combustion material wear of this covering would be significantly reduced and the service life of the grate bars will be considerably prolonged.

In operation the grate drums 1 are differently loaded over their axial lengths. This causes relative displacement between the grate bars 5 along the grate combustion track. Thereby clogging of the air slots 6, caused by a backed metal, would be prevented.

to interchange the fixed or suspended grate bars 11,5 in the case of damage or a routine wear-out, the fixed grate bars 11 can be easily released from the combustion space side. Suspended grate bars 5 can be then easily pulled out from the shaft 2 and replaced. This permits to reduce standstill time periods required for repairing or replacing the grate bars It will be understood that each of the elements described above, or two or more together, may also find a useful application in other types of drum-shaped grates for incinerators differing from the types described above.

While the invention has been illustrated and described as embodied in a drum-shaped grate of the incinerator, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. In a refuse-supporting grate of an incinerator, comprising a plurality of hollow rotary cylindrical drums each having an outer peripheral surface receiving refuse thereon, each drum having a central axis and including a plurality of grate bars extended parallel to each other and forming said outer peripheral surface, grate bar carriers extended parallel to said central axis, said grate bars being suspended in the direction transversal to said central axis between said carriers and on the latter so that between each two adjacent grate bars air slots are formed, each grate bar including a head portion having two side faces which are straight-line and smooth, the improvement comprising spaces between said grate bars, said grate bars each further including a foot portion having two opposite lateral faces, said spacers being positioned in pairs between the one lateral face of one grate bar and the lateral face of the adjacent grate bar, facing towards said one lateral face, the spacers in each pair having abutting surfaces abutting against each other, said abutting surfaces being flat and smooth, each of said suspended grate bars having two opposite recesses and two extended portions above said recesses, said bar carriers being partially inserted in said recesses, each bar carrier being inserted into an assigned recess so that the play occurs between the respective extended portion of the suspended grate bar and the respective bar carrier at operation temperature.

2. The grate as defined in claim 1, wherein each suspended grate bar has a cooling fine surface and a combustion track surface, the ratio between the cooling fin surface area and the combustion track surface area being at least 8:1.

3. The grate as defined on claim 1, wherein each drum has marginal zones and a middle zone in the direction of said central axis, the width of the grate bars in said marginal zones being greater than the width of the grate bars in said middle zone.

4. The grate as defined in claim 1, wherein said grate bars extend one after another along a circumferential circle to form parallel circular rows of the grate bars, and including fixed grate bars arranged in parallel circular rows, the circular rows of the fixed grate bars replacing some of the circular rows of said suspended grate bars, and connecting elements accessible from outside the drum for releasably connecting the fixed grate bars to the respective bar carriers.

5. The grate as defined in claim 4, wherein each fixed grate bar includes a lateral recess at one side of the bar and a lateral projection at another side of the bar, said fixed grate bars being positioned in each circular row so that the lateral projection of one fixed bar is inserted in the lateral recess of the adjacent fixed bar.

6. The grate as defined in claim 5, wherein each fixed grate bar has an outer combustion surface, said combustion surface having a plurality of openings.

7. The grate as defined in claim 6, wherein each of said lateral projections is inserted into the assigned lateral recess over the entire width of the respective fixed grate bar.

8. The grate as defined in claim 1, wherein said play is at least 1 mm.

* * * * *